US006772734B2

(12) United States Patent
Schueler

(10) Patent No.: US 6,772,734 B2
(45) Date of Patent: Aug. 10, 2004

(54) FUEL INJECTION SYSTEM FOR INTERNAL COMBUSTION ENGINES EXHIBITING IMPROVED START BEHAVIOR

(75) Inventor: Peter Schueler, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/169,379

(22) PCT Filed: Nov. 16, 2001

(86) PCT No.: PCT/DE01/04317

§ 371 (c)(1),
(2), (4) Date: Sep. 30, 2002

(87) PCT Pub. No.: WO02/40857

PCT Pub. Date: May 23, 2002

(65) Prior Publication Data

US 2003/0089341 A1 May 15, 2003

(30) Foreign Application Priority Data

Nov. 18, 2000 (DE) ..... 100 57 244

(51) Int. Cl.[7] ..... F02M 33/04
(52) U.S. Cl. ..... 123/446; 417/279; 123/514
(58) Field of Search ..... 123/446, 457, 123/458, 514; 417/279, 281, 307–309

(56) References Cited

U.S. PATENT DOCUMENTS

| | | | | |
|---|---|---|---|---|
| 4,884,545 A | * | 12/1989 | Mathis | 123/447 |
| 5,884,606 A | * | 3/1999 | Kellner et al. | 123/446 |
| 5,971,718 A | * | 10/1999 | Krueger et al. | 417/286 |
| 6,058,912 A | * | 5/2000 | Rembold et al. | 123/456 |
| 6,142,120 A | * | 11/2000 | Biester et al. | 123/458 |
| 6,234,148 B1 | * | 5/2001 | Hartke et al. | 123/447 |
| 6,253,734 B1 | * | 7/2001 | Rembold et al. | 123/446 |
| 6,439,199 B2 | * | 8/2002 | Ramseyer et al. | 123/446 |

FOREIGN PATENT DOCUMENTS

| | | |
|---|---|---|
| DE | 196 30 938 A | 2/1998 |
| DE | 197 42 180 A | 3/1999 |
| DE | 199 33 567 C | 2/2001 |

* cited by examiner

*Primary Examiner*—Thomas N. Moulis
(74) *Attorney, Agent, or Firm*—Ronald E. Greigg

(57) ABSTRACT

A fuel injection system in which, by means of a controlled zero-feed throttle or by the elimination of the zero-feed throttle and by a suitable control of the pressure valve of a common rail, the starting performance of the internal combustion engine can be improved, and at the same time it is assured that in the overrunning mode of the engine, an excessively high pressure is not built up in the common rail.

18 Claims, 6 Drawing Sheets

FUEL INJECTION SYSTEM FOR INTERNAL COMBUSTION ENGINES EXHIBITING IMPROVED START BEHAVIOR

CROSS-REFERENCE TO RELATED APPLICATIONS

This application is a 35 U.S.C. 371 application of PCT/DE 01/04317, filed on Nov. 16, 2001.

BACKGROUND OF THE INVENTION

1. Field of the Invention

The invention relates to a high-pressure fuel pump for a fuel injection system of an internal combustion engine, having at least one pump element, having a prefeed pump, having a metering valve, the prefeed pump pumping fuel from a tank to the suction side of the pump element or elements, and the fuel quantity pumped by the prefeed pump to the suction side of the pump element or elements being regulatable by the metering valve, and having a throttle for limiting the fuel outflow from the suction side of the pump element or elements, and to a fuel injection system embodying such a fuel pump.

2. Description of the Prior Art

For regulating the pumping quantity of a high-pressure fuel pump, a metering valve is disposed on the suction side of the pump elements of the high-pressure fuel pump and brings about a more or less pronounced throttling.

In the overrunning mode of the engine, or when a motor vehicle is moving downhill, fuel should not be injected into the combustion chambers of the engine. For this reason, in the overrunning mode the metering valve is closed. Since even in the closed state the metering valve has a certain leakage, even in the overrunning mode some quantity of fuel, although slight, reaches the pump elements and is aspirated by them. The fuel pumped by the pump elements, which is at high pressure, flows for instance into the common rail of the fuel injection system, and it can accordingly cause an undesirably high pressure to be built up in the overrunning mode, since the injectors are not injecting any fuel into the combustion chambers.

To prevent this, it is known to provide a so-called "zero-feed" throttle, through which small quantities of fuel can flow from the suction side of the pump elements out into a fuel return or to the suction side of the prefeed pump. This prevents a pressure from building up on the suction side of the pump elements and thus prevents the pump elements from being able to overcome the closing force of the suction valves. Consequently in the overrunning mode the pump elements aspirate no fuel, and the unwanted buildup of pressure in the common rail during the overrunning mode is averted.

A disadvantage of this provision is that the zero-feed throttle is opened even upon starting of the engine, and thus the pressure buildup on the suction side of the pump elements is delayed or more difficult. Consequently the engine requires a high starting rpm and does not start until after a certain amount of time.

The object of the invention is to furnish a high-pressure fuel pump for a fuel injection system, as well as a fuel injection system, for an internal combustion engine, which when they are used improve the starting performance of the engine.

This object is attained according to the invention by a high-pressure fuel pump for a fuel injection system of an internal combustion engine, having at least one pump element, having a prefeed pump, having a metering valve, the prefeed pump pumping fuel from a tank to the suction side of the pump element or elements, and the fuel quantity pumped by the prefeed pump to the suction side of the pump element or elements being regulatable by the metering valve, and having a controllable throttle for limiting the fuel outflow from the suction side of the pump element or elements.

SUMMARY OF THE INVENTION

In the high-pressure fuel pump of the invention, the throttle can be closed during starting, so that the pressure buildup on the suction side of the pump elements is completed faster and the starting performance of the engine is thus improved.

In a variant of the invention, it is provided that the throttle closes when the fuel pressure on the compression side of the prefeed pump is below a first reference value, so that in all operating states in which the fuel supply to the high-pressure fuel pump is inadequate, the throttle is closed, and hence the entire amount of fuel pumped by the prefeed pump is available to the pump elements.

In a further feature of the invention, the throttle is controlled by a control valve that is subjected to the fuel pressure on the compression side of the prefeed pump, so that the control of the throttle is accomplished in a simple, reliable way. A control unit of the fuel injection system is not needed for this purpose.

In a further refinement of the invention, it is provided that the control valve also controls the inflow of fuel into the high-pressure fuel pump for the sake of lubrication, so that both functions, namely the control of the throttle and of the inflow of fuel into the high-pressure fuel pump for lubrication, can be accomplished simply and economically with one valve.

In a further feature of the invention, it is provided that the control valve is a cascade valve, and that the control valve controls the inflow of fuel into the high-pressure fuel pump for the sake of lubrication in a plurality of stages, thus on the one hand assuring that the high-pressure fuel pump is always adequately lubricated and on the other that there is enough fuel available to the pump elements at low rotary speeds.

It is especially advantageous if the throttle is integrated with the control valve, so that the number of component groups and connecting lines required is less, and less space is needed.

Further features of the invention provide that the throttle communicates on the outlet side with a return line that discharges into the tank, or with the suction side of the prefeed pump, or with the lubrication of the high-pressure fuel pump, so that regardless of how the throttle is connected on the outlet side, the advantages of the invention can be exploited.

The object stated above is also attained according to the invention by a fuel injection system for an internal combustion engine, having a high-pressure fuel pump, wherein the high-pressure fuel pump has at least one pump element, having a prefeed pump, having a metering valve, wherein the prefeed pump pumps fuel from a tank to the suction side of the pump element or elements, and the fuel quantity pumped by the prefeed pump to the suction side of the pump element or elements is regulatable by the metering valve, having a common rail communicating with the compression side of the high-pressure fuel pump, wherein the common rail can be made to communicate with a fuel return via a pressure regulating valve, and wherein in the overrunning mode of the engine, the pressure regulating valve is opened and the metering valve is closed.

In this fuel injection system, a zero-feed throttle can be dispensed with, since in the overrunning mode the pressure regulating valve is opened, and thus the pressure in the common rail drops so far that a pressure buildup in the overrunning mode is impossible. The fuel quantity pumped by the high-pressure fuel pump in the overrunning mode is equivalent to the leakage from the metering system and is very slight. An especially advantageous feature of the fuel injection system of the invention is that the function of the zero-feed throttle is achieved by means of a suitable triggering of the pressure valve that is present anyway and the metering valve that is also present anyway. This simplifies the structure of the fuel injection system and enhances its reliability.

In other features of the fuel injection system, it is provided that the pressure valve is a blocking or flow valve, and/or that a control unit is provided for controlling the fuel injection system, so that depending on the concept of regulation in the fuel injection system, the pressure in the common rail can be controlled by a blocking valve or a flow valve.

In another embodiment of the invention, the prefeed pump is a geared pump, and the prefeed pump is driven by the high-pressure fuel pump or by the engine. Since in high-pressure fuel pumps of this design, the rpm and thus the pumping capacity of the prefeed pump depend directly on the rpm of the engine, the pressure buildup on the suction side of the pump elements upon engine starting proceeds relatively slowly, so that the advantages of the high-pressure fuel pump of the invention and of the fuel injection system of the invention are especially advantageously attained.

BRIEF DESCRIPTION OF THE DRAWINGS

Further advantages and advantageous features of the invention can be learned from the detailed description herein below, taken in conjunction with the drawings, in which.

DESCRIPTION OF THE PREFERRED EMBODIMENTS

Figure 1:
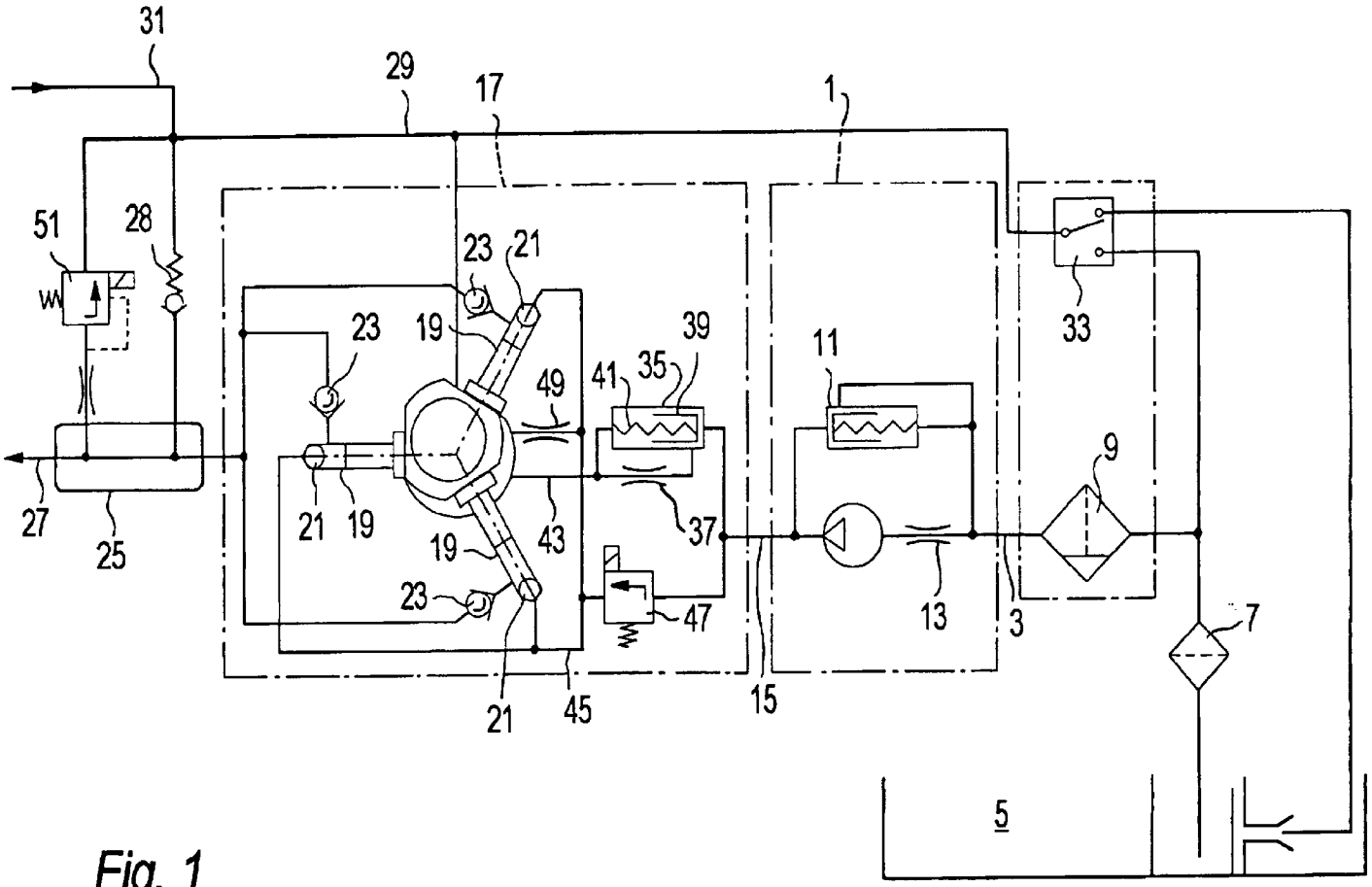
Fig. 1 PRIOR ART
FIG. 1, a fuel injection system of the prior art.

In FIG. 1, a common rail injection system of the prior art is shown schematically. A prefeed pump 1, via an inlet line 3, aspirates fuel, not shown, from a tank 5. The fuel is filtered in a prefilter 7 and a filter with a water trap 9.

The prefeed pump 1 is embodied as a geared pump and has a first overpressure valve 11. On the suction side, the prefeed pump is throttled by a first throttle 13. A compression side 15 of the prefeed pump 1 supplies fuel to a high-pressure fuel pump 17. The high-pressure fuel pump 17 is embodied as a radial piston pump, with three pump elements 19, and it drives the prefeed pump 1. One suction valve 21 is provided on the suction side of each of the pump elements 19. One check valve 23 is provided on the compression side of each of the pump elements 19 and prevents the fuel, which is at high pressure and has been pumped into a common rail 25 by the pump elements 19, from being able to flow back into the pump elements 19.

The high-pressure lines of the fuel injection system are represented by heavy lines in FIGS. 1 through 5, while the regions of the fuel injection system that are at a low pressure are represented by fine lines.

The common rail 25 supplies one or more injectors, not shown in FIG. 1, with fuel via a high-pressure line 27. A second overpressure valve 28, which as needed connects the common rail to a return line 29, prevents excessively high pressures in the high-pressure region of the fuel injection system. Via the return line 29 and a leakage line 31, the leakage and the control quantities for the injector or injectors, not shown, are returned to the tank 5.

Via a switching valve 33, the fuel located in the return line 29 can also be transported into the inlet line 3 of the prefeed pump 1, so that the risk of gelatinization at low temperatures is reduced.

The high-pressure fuel pump 17 is supplied by the prefeed pump 1 with fuel for the pump elements 19 on the one hand and fuel for lubrication on the other. The fuel quantity used for lubricating the high-pressure fuel pump 17 is controlled via a first control valve 35 and a second throttle 37. In the position shown in FIG. 1 for the first control valve 35, the pressure on the compression side 15 of the prefeed pump 1 is not sufficient to move a piston 39 of the first control valve 35 counter to the spring force of a spring 41. As a consequence, the first control valve 35 is shown closed in FIG. 1. As soon as the pressure on the compression side 15 rises, the piston 39 moves to the left counter to the spring force of the spring 41 and opens the line 43. Via the line 43 and the second throttle 37, flow for lubricating the high-pressure fuel pump 17 flows into the crankcase of this pump.

Via a distribution line 45, the high-pressure fuel pump 17 also supplies the pump elements 19 with fuel. For regulating the pumping quantity of the high-pressure fuel pump 17, a metering valve 47 is provided between the compression side 15 of the prefeed pump 1 and the distribution line 45. The metering valve 47 is a flow valve, which is triggered by a control unit, not shown, of the fuel injection system. The pump elements 19 are thus throttled on the suction side via the metering valve 47.

In the overrunning mode, that is, when a vehicle is travelling downhill, for instance, no fuel is supposed to flow into the pump elements 19, and accordingly no fuel is to be injected by the injectors, not shown, into the combustion chambers of the engine. Since for production and functional reasons the metering valve 47 in the closed state still has a leakage quantity that flows into the distribution line 45, a pressure would build up on the suction side of the pump elements 19, unless suitable remedies are provided, that would be so high that the pump elements would open the suction valves 21 during the intake stroke and would aspirate fuel. The consequence would be that the pressure in the common rail 25 would rise excessively.

To prevent this, a third throttle 49 is provided, which will hereinafter also be called a zero-feed throttle. Through the zero-feed throttle 49, the fuel can flow out of the distribution line 45 into the crankcase of the high-pressure fuel pump 17, where it can be used to lubricate the high-pressure fuel pump 17. Because of the outflow of fuel through the zero-feed throttle 49, the aforementioned pressure buildup in the distribution line 45 in the overrunning mode resulting from leakage from the closed metering valve 47 is averted.

A disadvantage of this provision is that the zero-feed throttle 49 is always open, and thus especially at low rpm, of the kind that occurs when the engine is started, the desired pressure buildup in the distribution line 45 is prevented by the outflow of fuel through the zero-feed throttle 49.

The pressure in the common rail 25 is regulated via a pressure valve 51, which can also be embodied as a flow valve. The pressure valve 51 is likewise triggered by the control unit, not shown.

In FIGS. 2 through 5, various embodiments according to the invention for a fuel injection system are shown; for identical components, the same reference numerals are used, and reference can be had to the description of FIG. 1.

Figure 2:
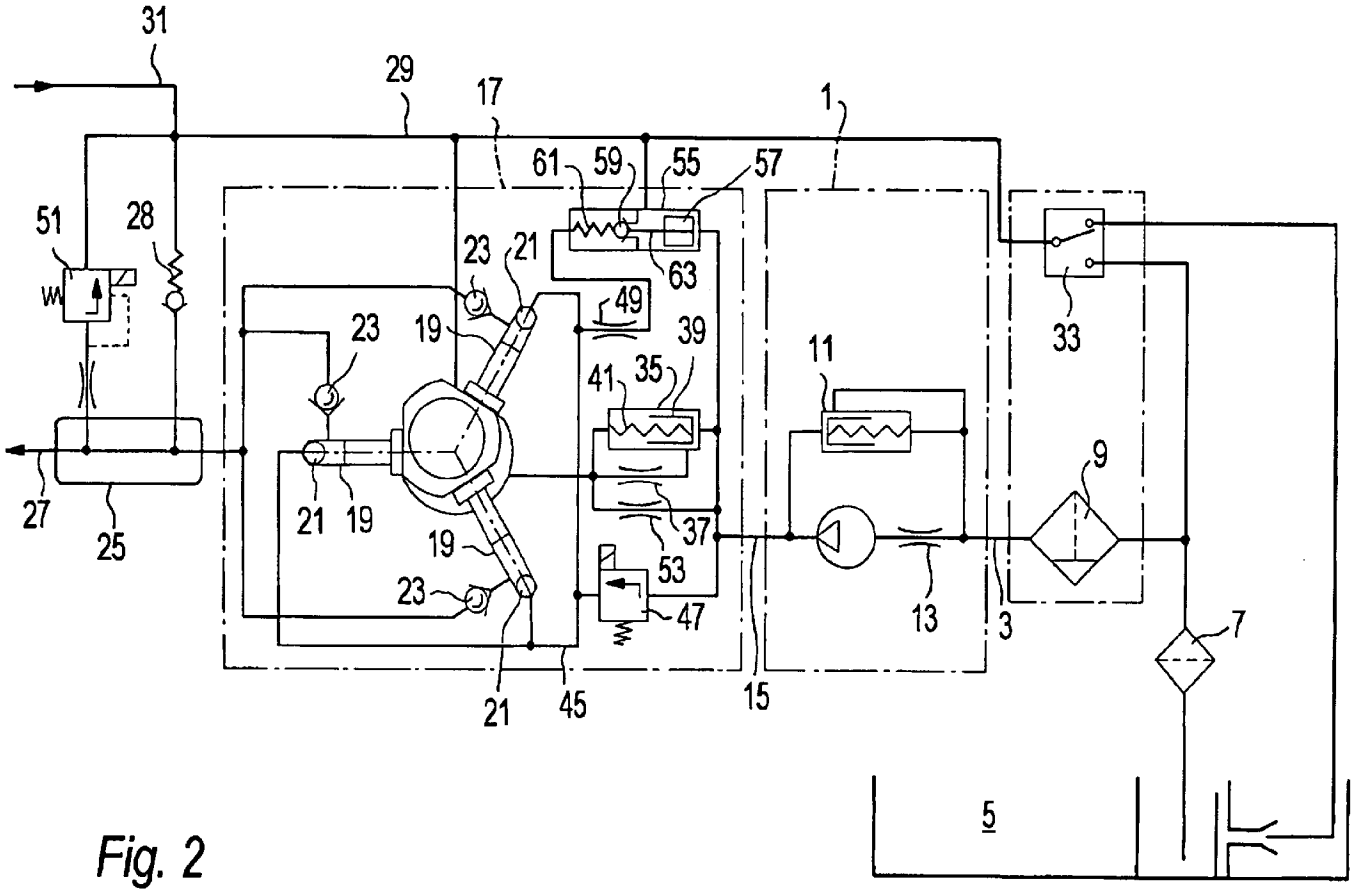
FIGS. 2–5, exemplary embodiments of fuel injection systems of the invention.

In FIG. 2, the first control valve 35 is connected parallel to a fourth throttle 53, serving to ventilate the system, so that with the onset of pumping by the prefeed pump 1, fuel for lubrication also reaches the high-pressure fuel pump 17. In this exemplary embodiment, the zero-feed throttle 49 connects the distribution line 45 with the return line 29. The flow through the zero-feed throttle 49 is controlled by a second control valve 55. The second control valve 55 has a piston 57, which is subjected to the pressure of the compression side of the prefeed pump 1. If the pressure on the compression side 15 is low, a ball 59 is pressed by a spring 61 into a sealing seat and thus closes the second control valve 55. As soon as the pressure on the compression side 15 of the prefeed pump 1 exceeds a first reference value, the piston 57 moves to the left and via a pin 63 lifts the ball 61 from its seat, and thus opens the second control valve. As a result, the control valve 55 means that in the starting process the pressure buildup in the distribution line 45 is speeded up, since no fuel is flowing out through the zero-feed throttle 49. The high-pressure fuel pump 17 consequently begins to pump earlier, the pressure buildup in the common rail 25 is speeded up, and the engine begins to work earlier and at lower rpm levels.

If the motor is in the overrunning mode, that is, if it is operating at a higher rpm than idling but with a closed metering valve 47, the pressure on the compression side 15 of the prefeed pump is high enough to open the second control valve 55 and thus to assure the above-described function of the zero-feed throttle 49. This is especially advantageous if the prefeed pump 1 is driven directly by the high-pressure fuel pump 17, since in that case the rpm of the engine, of the high-pressure fuel pump, and of the prefeed pump 1 are the same.

Figure 3:
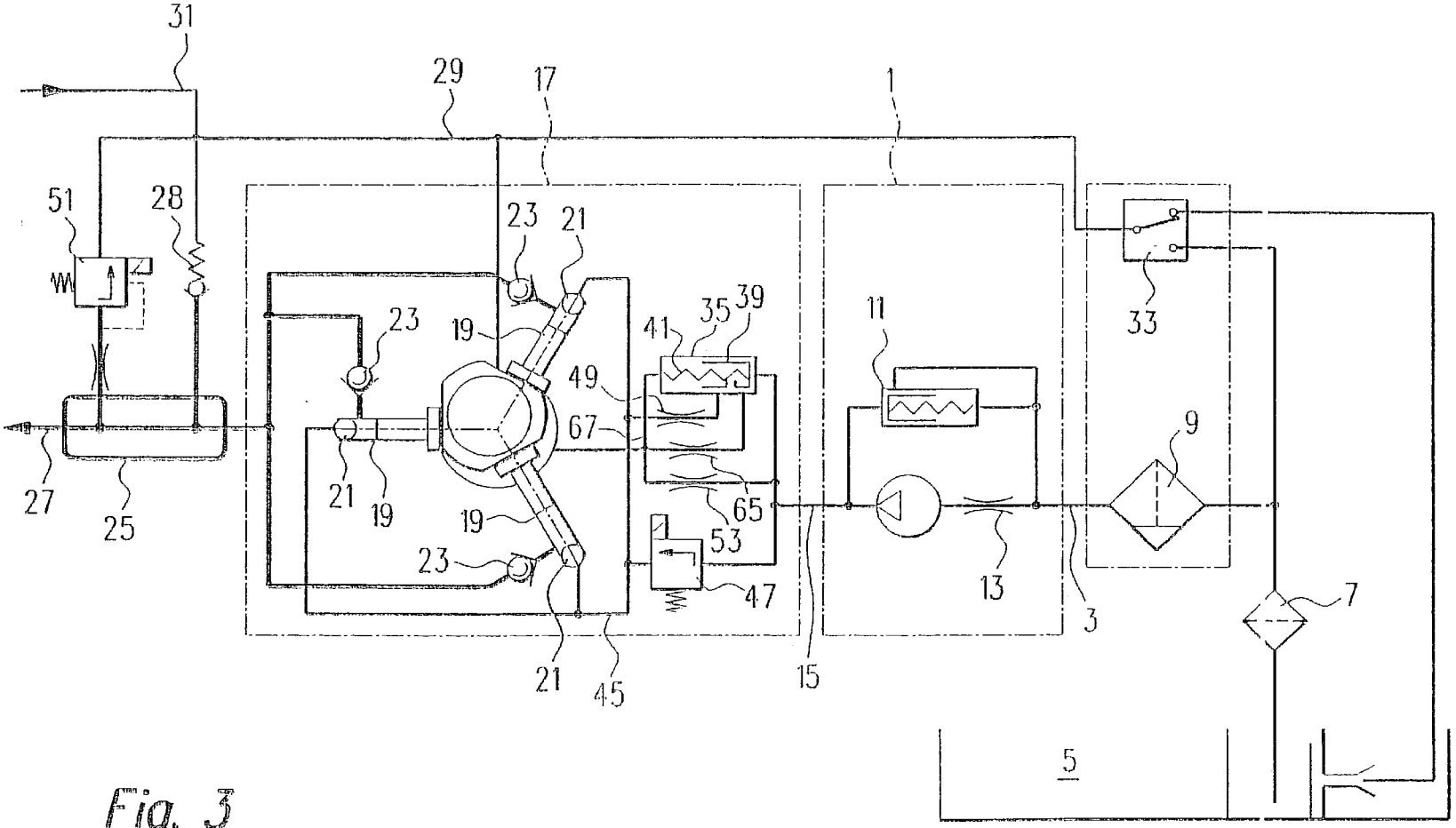
Figure 4:
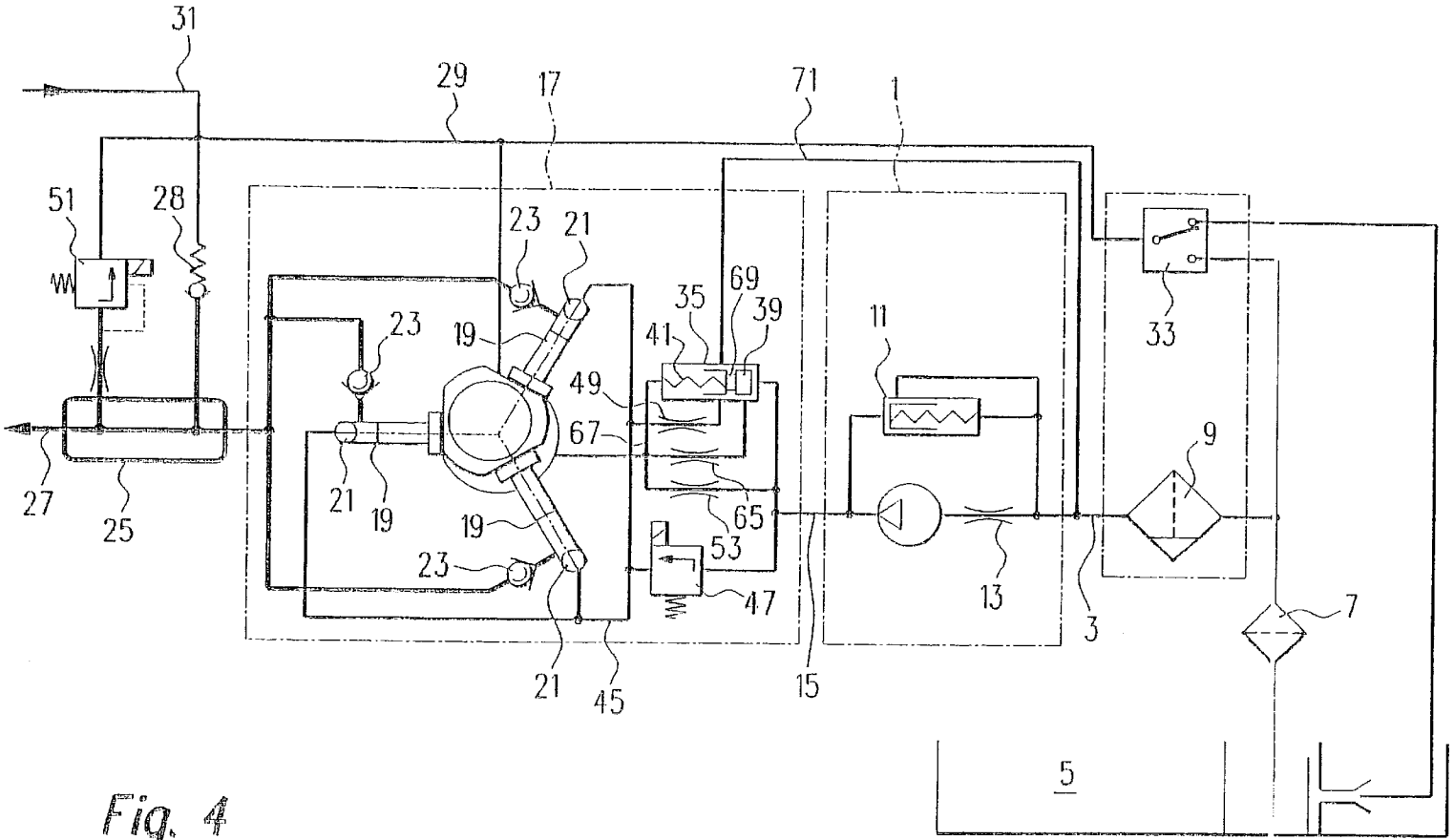

In the exemplary embodiment of FIG. 3, the control of the zero-feed throttle 49 is integrated with the first control valve 35. The first control valve 35 is embodied as a cascade valve; that is, the fuel for lubricating the high-pressure fuel pump 17, given an only slight pressure on the compression side 15 of the prefeed pump 1, can flow through the fourth throttle 53, serving to ventilate the system, into the crankcase of the high-pressure fuel pump 17. As soon as the pressure on the compression side 15 of the prefeed pump 1 exceeds a first reference value, the first control valve opens and uncovers a fifth throttle 65, which is connected parallel to the fourth throttle 53. Thus the fuel flow furnished for lubricating the high-pressure fuel pump 17 is increased, which is necessary especially at relatively high rpm of the high-pressure fuel pump 17 and thus also of the prefeed pump 1. Once the first reference value on the compression side 15 is reached, the zero-feed throttle 49 is also opened through an opening in the piston 39 of the first control valve 35. Via a leakage drain 67 of the first control valve, fuel, which has reached the first control valve 35 from the distribution line 45 via the zero-feed throttle 49, is drained away and used to lubricate the high-pressure fuel pump 17.

It is also possible for the opening of the zero-feed throttle 49 and of the fifth throttle 65 takes place at different pressures on the compression side 15 of the prefeed pump 1. In the exemplary embodiment of FIG. 4, the first control valve 35 is again embodied as a cascade valve. The piston 39 of the first control valve 35 has an annular groove 69, which when a first reference value on the compression side 15 of the prefeed pump 1 is attained is located such that the zero-feed throttle 49 communicates with an outlet line 71. The outlet line 71 discharges into the inlet line 3 of the prefeed pump 1.

Figure 5:
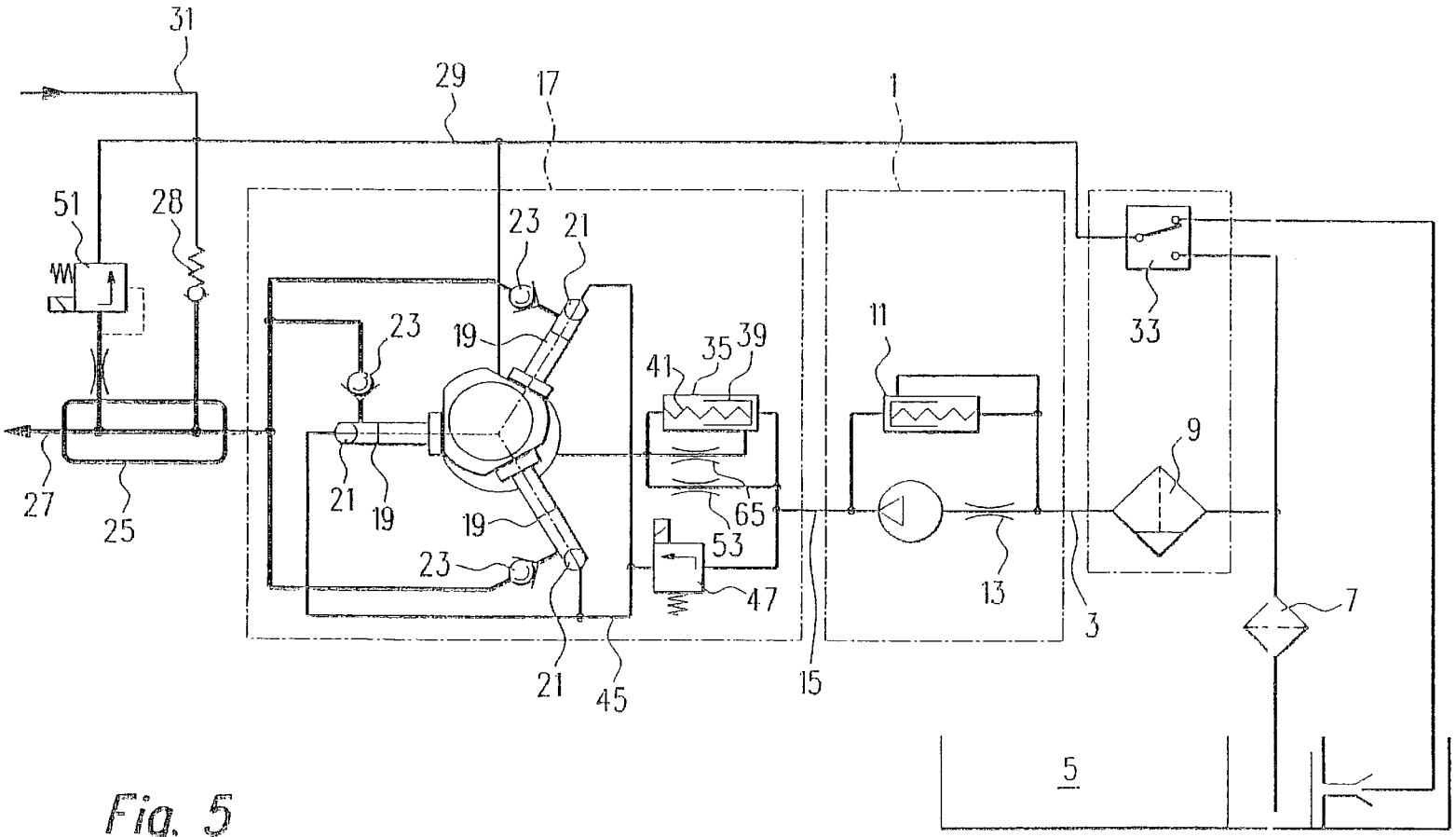

In the exemplary embodiment of FIG. 5, there is no zero-feed throttle 49. The first control valve 35 supplies the high-pressure fuel pump 17 with fuel for lubrication in the manner described above, while the pump elements 19 are supplied with fuel via the distribution line 45. Upon starting of the engine, the pressure valve 51, which is also responsible for regulating the pressure in the common rail 25, is closed. The pressure buildup in the distribution line 45 takes place just as fast, since there is no zero-feed throttle 49, as in the exemplary embodiments of FIGS. 2 through 4, in which the zero-feed throttle 49 is closed during starting. Since the first control valve 35 is embodied as a cascade valve, ventilation of the inlet line 3, prefeed pump 1 and compression side 15 of the prefeed pump 1 can be effected through the fourth throttle 53, which has a very small cross section.

In the overrunning mode of the engine, the metering valve 47 is closed. The leakage quantity from the metering valve 47 flows into the distribution line 45 and reaches the pump elements 19, as soon as the pressure in the distribution line 45 is high enough and the pump elements 19 can open the suction valves 21 during the intake stroke. Since the pressure valve 51 is opened during the overrunning mode, the pressure in the common rail 25 is not high, as it is in FIG. 1; on the contrary, a low pressure prevails through the entire injection system. Consequently, the pumping work of the pump elements 19 is slight, and the pressure in the common rail 25 is so slight that the injectors (not shown) do not open, since the fuel pressure is not sufficient to overcome the closing force of the nozzle spring of the injectors. In other words, as a result of the triggering according to the invention of the metering valve 47 and the pressure valve 51, it is possible to dispense with a zero-feed throttle 49 without sacrifices in terms of the function of the fuel injection system.

Figure 6:
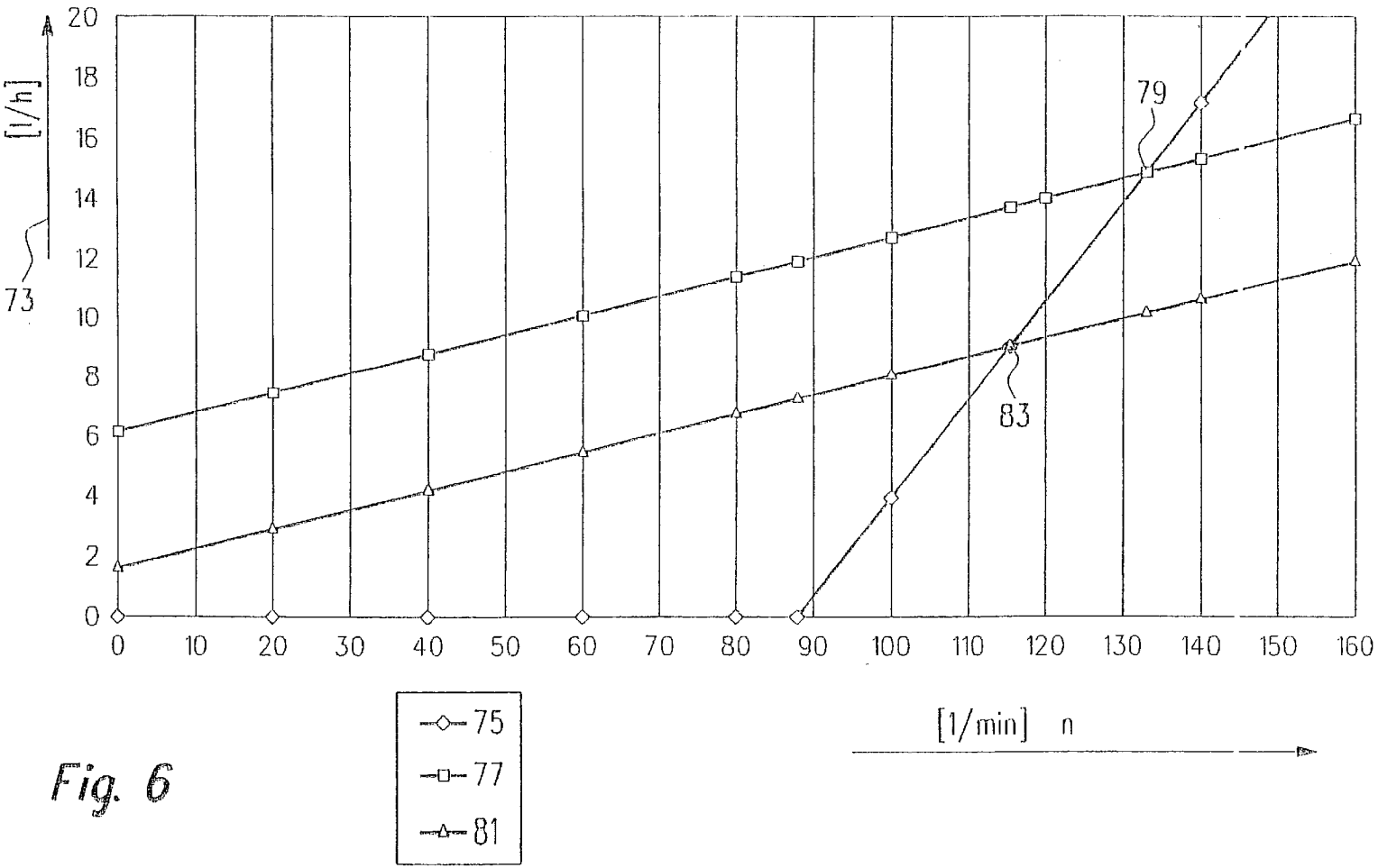
FIG. 6, a graph from which the advantages of the fuel injection system of the invention are demonstrated.

For clear illustration of the advantages of the fuel injection system of the invention, FIG. 6 shows a graph in which a flow rate 73 is plotted over an rpm n. A first line 75 represents the pumping quantity of the prefeed pump 1 as a function of the rpm n. A second line 77 shows the fuel demand of a high-pressure fuel pump 17 in the prior art. The fuel demand of the high-pressure fuel pump 17 in the prior art is essentially composed of the rpm-dependent pumping quantity of the pump elements 19 and the differential-pressure-dependent volumetric flow through the zero-feed throttle 49. At the intersection 79 between the first line 75 and the second line 77, the starting rpm of an internal combustion engine equipped with a fuel injection system of the prior art is attained. In the present example, this starting rpm is 133 revolutions per minute.

A third line 81 represents the fuel demand of an internal combustion engine equipped with a fuel injection system according to the invention. The rpm-dependent fuel demand 81 of the high-pressure fuel pump 17 of the invention depends only on the pumping quantity of the pump elements 19, and thus over the entire rpm range it is less than the fuel demand of an internal combustion engine of the prior art (see second line 77). Consequently, the intersection 83 between the third line 81 and the first line 75 is reached at a lower rpm. In the example of FIG. 6, the starting rpm of an internal combustion engine equipped with the fuel injection system of the invention is 116 revolutions per minute. In other words, the engine starts faster; the starter and the on-board electrical system are burdened less; and starting is still possible even under less-favorable ambient conditions.

The foregoing relates to preferred exemplary embodiments of the invention, it being understood that other variants and embodiments thereof are possible within the spirit and scope of the invention, the latter being defined by the appended claims.

I claim:

1. A high-pressure fuel pump for a fuel injection system of an internal combustion engine, comprising at least one pump element (19), a prefeed pump (1), a metering valve (47), the prefeed pump (1) pumping fuel from a tank (5) to the suction side of the pump element or elements (19), and the fuel quantity pumped by the prefeed pump (1) to the suction side of the pump element or elements (19) being regulatable by the metering valve (47), and a controllable throttle (49) for limiting the fuel inflow from the suction side of the pump element or elements (19), wherein the throttle (49) closes when the fuel pressure on the compression side (15) of the prefeed pump (1) is below a first reference value, and wherein the throttle (49) is controlled by a control valve (55) that is subjected to the fuel pressure on the compression side (15) of the prefeed pump (1).

2. A high-pressure fuel pump for a fuel injection system of an internal combustion engine, comprising at least one pump element (19), a prefeed pump (1), a metering valve (47), the prefeed pump (1) pumping fuel from a tank (5) to the suction side of the pump element or elements (19), and the fuel quantity pumped by the prefeed pump (1) to the suction side of the pump element or elements (19) being regulatable by the metering valve (47), and a controllable throttle (49) for limiting the fuel inflow from the suction side of the pump element or elements (19), wherein the throttle (49) is controlled by a control valve (55) that is subjected to the fuel pressure art the compression side (15) of the prefeed pump (1), and wherein the control valve (35) also controls the inflow of fuel into the high-pressure fuel pump for the sake of lubrication.

3. The high-pressure fuel pump of claim 1 wherein the control valve (35) also controls the inflow of fuel into the high-pressure fuel pump for the sake of lubrication.

4. The high-pressure fuel pump of claim 2 wherein the control valve (35) is a cascade valve, and that the control valve (35) controls the inflow of fuel into the high-pressure fuel pump (17) for the sake of lubrication in a plurality of stages.

5. The high-pressure fuel pump of claim 3 wherein the control valve (35) is a cascade valve, and that the control valve (35) controls the inflow of fuel into the high-pressure fuel pump (17) for the sake of lubrication in a plurality of stages.

6. The high-pressure fuel pump of claim 2 wherein the throttle (49) is integrated with the control valve (55, 35).

7. The high-pressure fuel pump of claim 2 wherein the throttle (49) is integrated with the control valve (55, 35).

8. The high-pressure fuel pump of claim 4 wherein the throttle (49) is integrated with the control valve (55, 35).

9. The high-pressure fuel pump of claim 1 wherein the throttle (49) communicates on the outlet side with a return line (29) that discharges into the tank (5).

10. The high-pressure fuel pump of claim 2 wherein the throttle (49) communicates on the outlet side with a return line (29) that discharges into the tank (5).

11. The high-pressure fuel pump of claim 1 wherein the throttle (49) communicates on the outlet side with an inlet line (3) of the prefeed pump (1).

12. The high-pressure fuel pump of claim 1 wherein the throttle (49) communicates on the outlet side with the lubrication of the high-pressure fuel pump (17).

13. A fuel injection system for an internal combustion engine, comprising a high-pressure fuel pump (17) having at least one pump element (19), a prefeed pump (1), a metering valve (47), the prefeed pump (1) being operable to pump fuel from a tank (5) to the suction side of the pump element or elements (19), and the fuel quantity pumped by the prefeed pump (1) to the suction side of the pump element or elements (19) being regulatable by the metering valve (47), a common rail (25) communicating with the compression side of the high-pressure fuel pump (17), and a pressure regulating valve (51) operable to connect the common rail (25) to communicate with a fuel return (29), the pressure regulating valve (51), being opened and the metering valve (47) being closed in the overrunning mode of the engine.

14. The fuel injection system of claim 13 wherein the pressure valve (51) is a blocking or flow valve.

15. The fuel injection system of claim 13, further comprising a control unit for controlling the fuel injection system.

16. The fuel injection system of claim 14 further comprising a control unit for controlling the fuel injection system.

17. The high-pressure fuel pump of claim 1 wherein the prefeed pump (1) is a geared pump, driven either by the high-pressure fuel pump (17) or by the engine.

18. A high-pressure fuel pump for a fuel injection system of an internal combustion engine, comprising at least one pump element (19), a prefeed pump (1), a metering valve (47), the prefeed pump (1) pumping fuel from a tank (5) to the suction side of the pump element or elements (19), and the fuel quantity pumped by the prefeed pump (1) to the suction side of the pump element or elements (19) being regulatable by the metering valve (47), and a controllable throttle (49) for limiting the fuel inflow from the suction side of the pump element or elements (19), wherein the throttle (49) doses when the fuel pressure on the compression side (15) of the prefeed pump (1) is below a first reference value, and wherein the throttle (49) is controlled by a control valve (55) that is subjected to the fuel pressure on the compression side (15) of the prefeed pump (1), a common rail (25) communicating with the compression side of the high-pressure fuel pump (17), a pressure regulating valve (51) operable to connect the common rail (25) to communicate with a fuel return (29), and a pressure regulating valve (51), being open and the metering valve (47) being closed in the overrunning mode of the engine.

* * * * *